US006800253B2

(12) United States Patent
Winter et al.

(10) Patent No.: US 6,800,253 B2
(45) Date of Patent: Oct. 5, 2004

(54) APPARATUS AND PROCESS FOR IMPROVED AROMATIC EXTRACTION FROM GASOLINE

(75) Inventors: George Winter, Prospect Park, IL (US); Zvi Merchav, Haifa (IL)

(73) Assignee: Denim Engineering, Inc., Park Ridge, IL (US)

( * ) Notice: Subject to any disclaimer, the term of this patent is extended or adjusted under 35 U.S.C. 154(b) by 314 days.

(21) Appl. No.: 09/932,825

(22) Filed: Aug. 17, 2001

(65) Prior Publication Data

US 2002/0071796 A1 Jun. 13, 2002

Related U.S. Application Data

(60) Division of application No. 09/735,452, filed on Dec. 12, 2000, now Pat. No. 6,303,021, which is a continuation-in-part of application No. 09/298,428, filed on Apr. 23, 1999, now abandoned.

(51) Int. Cl.[7] ..... C10G 21/28; C07C 7/00

(52) U.S. Cl. ..... 422/144; 422/189; 208/321; 585/804

(58) Field of Search ..... 422/144, 188, 422/189, 193; 585/804, 833, 834; 196/14, 52; 208/321, 335

(56) References Cited

U.S. PATENT DOCUMENTS

| | | | | | |
|---|---|---|---|---|---|
| 2,933,448 | A | * | 4/1960 | Morin et al. | 208/324 |
| 4,336,106 | A | * | 6/1982 | Winter, III | 196/14.52 |
| 5,059,306 | A | * | 10/1991 | Kramer et al. | 208/313 |
| 5,176,821 | A | * | 1/1993 | Forte | 208/313 |
| 5,308,592 | A | * | 5/1994 | Yang et al. | 422/191 |
| 5,336,840 | A | * | 8/1994 | Forte | 585/833 |
| 5,399,244 | A | * | 3/1995 | Gentry et al. | 203/23 |
| 5,877,384 | A | * | 3/1999 | Gimpel et al. | 585/804 |

* cited by examiner

*Primary Examiner*—Kiley Stoner
*Assistant Examiner*—Kevin L McHenry
(74) *Attorney, Agent, or Firm*—Kajane McManus

(57) ABSTRACT

The improved process and apparatus of the present invention for extracting high purity aromatics from gasoline using a glycol solvent based extraction process decrease liquid-vapor flashing, reduce reflux flow rate, and use heat of enthalpy produces at one point as a source of energy used at another point, decreasing energy consumption while significantly increasing purity and amount of product obtained.

1 Claim, 2 Drawing Sheets

APPARATUS AND PROCESS FOR IMPROVED AROMATIC EXTRACTION FROM GASOLINE

CROSS REFERENCE TO RELATED APPLICATIONS

This application is a Divisional application of U.S. application Ser. No. 09/735,452, filed Dec. 12, 2000 now U.S. Pat. No. 6,303,021, of the same title, which is a Continuation In Part of U.S. application Ser. No. 09/298,428 filed Apr. 23, 1999, of the same title, now abandoned.

BACKGROUND OF THE INVENTION

1. Field of the Invention

The present invention relates to an improved apparatus and process for extracting high-purity aromatics from gasoline which increases system capacity while reducing energy consumption.

2. Prior Art

Several commercially proven processes and apparatus are available for extracting high-purity aromatics from gasoline, coke oven light oil, and pyrolysis naphtha. Most include a liquid-liquid extractor followed by an extractive distillation column for extracting a high-purity aromatic stream, apparatus for removing solvent from the product streams, and solvent conditioning facilities.

The extraction of benzene and heavier aromatic homologs has been practiced commercially for about a century. Prior to the preparation of high-octane gasoline from crude oil, aromatics were extracted from liquids produced during the coking and gasification of coal. With the advent of platinum reforming ("Platforming") in the late 1940's, a large source of less expensive aromatics became available in oil refineries.

At about the same time Dow and others were developing commercial plants to produce ethylene glycol for the automotive antifreeze market. One of the heavy byproducts of this process was di-ethylene glycol. Dow found that this material could be used to extract aromatics from gasoline, and developed a process to accomplish this.

Dow made an arrangement for UOP to market the process once it was proved, naming it UDEX in honor of the new partnership promoting the process. This process dominated the extraction field through the 1950's until the Shell Sulfolane process supplanted it in the 1960's.

The early UDEX units used di-ethylene glycol ("DEG") and di-glycol amine ("DGA") for solvents. The consumption of energy was typically in the range of 1200 to 1500 BTU/pound of extract. In the early 1960's, tri-ethylene glycol replaced most of the DEG/DGA, reducing energy consumption to 1000 to 1200 BTU/pound of extract, and increasing unit capacity by 20 to 30%. In the 1970's, tetra-ethylene glycol replaced most of the tri-ethylene. With this change, the energy consumption dropped to the range of 800 to 1000 BTU/pound of extract and the capacity increased another 10 to 20%. A solvent additive called "Carom" was used in the 1960's to decrease the energy consumption and increase capacity, each changing in the range of 5 to 10%.

The introduction of the Shell Sulfolane process in the 1960's ended the design and construction of most UDEX apparatus. The Shell Sulfolane apparatus usually consumes less than 700 BTU/pound of extract. While this is a strong advantage, the process has two important disadvantages.

First, the Sulfolane process requires four large columns rather than the two required for the UDEX process. This increases capital cost.

Second, the solvent can become corrosive. Reboiler replacement and exotic metallurgy are not uncommon due to this corrosive nature. Entire columns have had to be replaced at times.

Thus, because of the low capital cost and non-corrosive nature of the glycol units, a UDEX apparatus having a low consumption of energy would have substantial application in the aromatics field.

SUMMARY OF THE INVENTION

Accordingly, it is a primary object of the invention to produce an improved process and apparatus for glycol based extraction of aromatics from gasoline and the like commonly referred to as the UDEX process.

Such object, as well as others, is accomplished by the process and apparatus of the present invention which decrease liquid-vapor flashing, reduce reflux flow rate, and use heat of enthalpy produced at one point as a source of energy used at another point, decreasing energy consumption while significantly increasing purity and amount of product obtained.

DESCRIPTION OF THE PREFERRED EMBODIMENT

Figure 1:
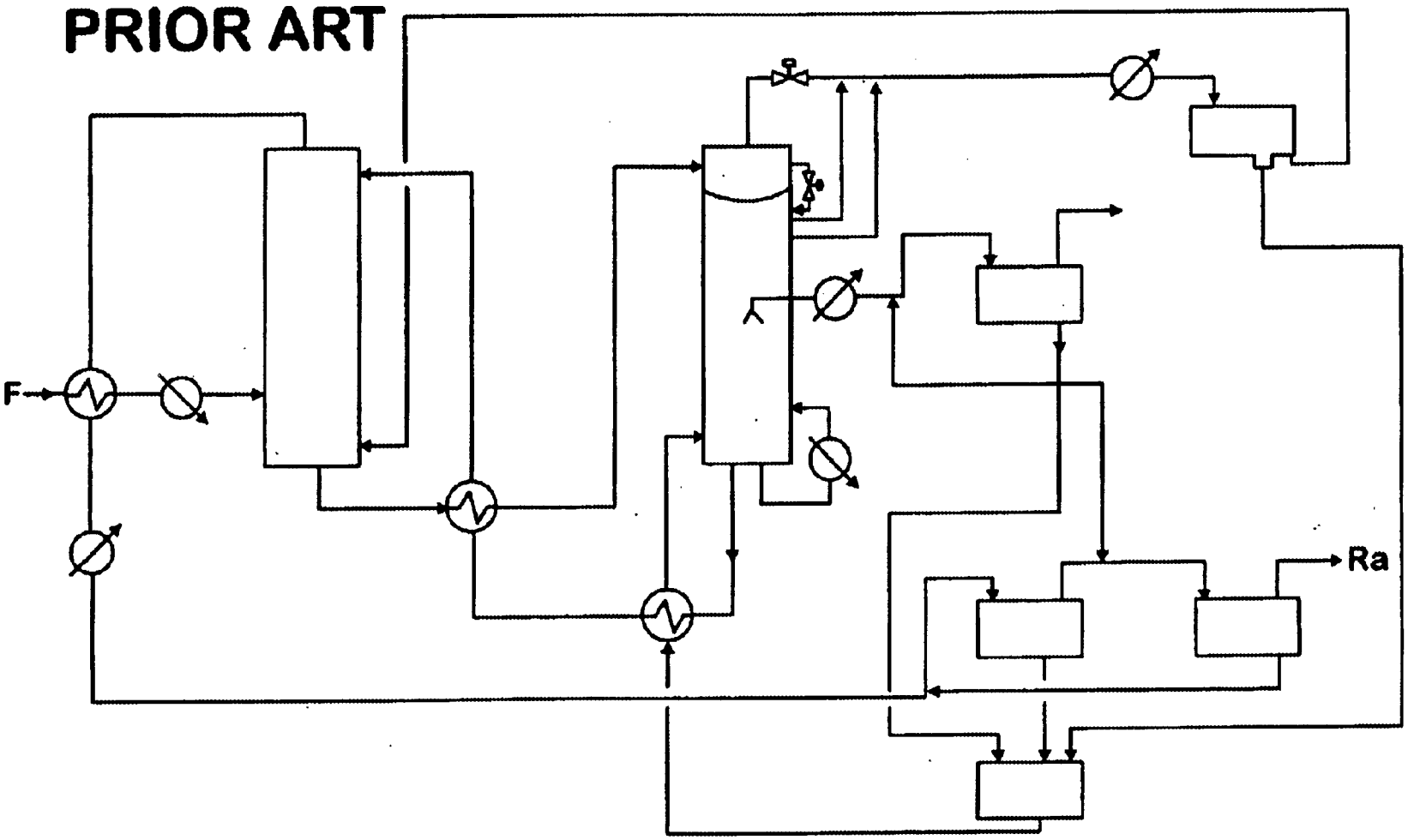
Fig. 1 PRIOR ART
FIG. 1 is a schematic diagram of the prior art apparatus, commonly referred to as UDEX, used in the glycol based process of extracting aromatics from gasoline.

Traditional apparatus for carrying out the UDEX process is shown in FIG. 1. Inasmuch as the apparatus of the present invention adds onto existing apparatus, for the sake of brevity, the description of FIG. 2 will incorporate a description of the apparatus of FIG. 1.

Figure 2:
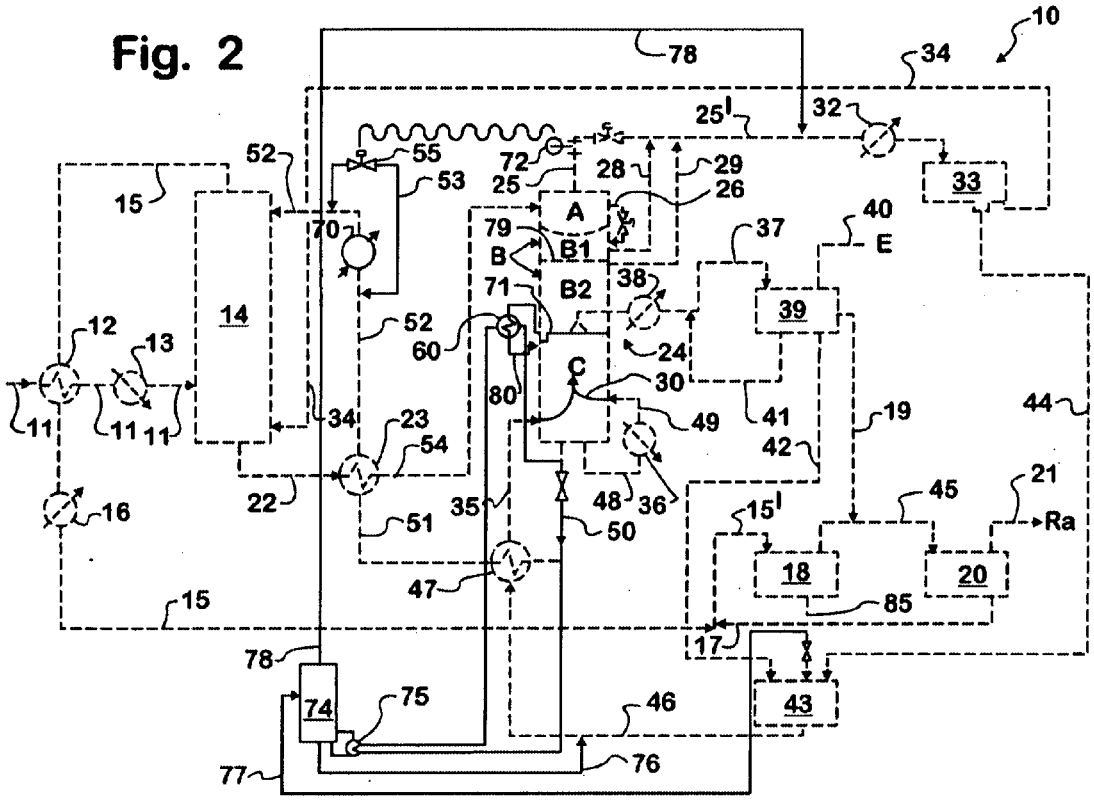
FIG. 2 is a schematic diagram showing the apparatus of FIG. 1 shown in phantom incorporating structure not shown in phantom proposed for addition for carrying out the process of the present invention in an improved manner, increasing yield while at the same time decreasing energy consumption.

FIG. 2 shows the UDEX apparatus of FIG. 1 in phantom and incorporates added structure to provide the improved apparatus of the present invention commonly referred to by reference numeral 10. The description will further define process flow as it relates to the apparatus 10.

A feed stream 11, normally at ambient temperature, is first heated with raffinate in a suitable heat exchanger 12 and further heated in a suitable heater 13 before being sent to an extractor column 14.

Raffinate stream 15 exits at the top of the extractor column 14, is cooled in the heat exchanger 12 and is cooled again in a suitable cooler 16. The cooled raffinate stream 15 is mixed with a recycled water stream 17 to extract solvent from the raffinated stream 15, and the combined stream 15' is sent to a separator 18 where the water and solvent separate from the raffinate into what is defined as a heavy phase 85.

The raffinate, defined as a light hydrocarbon phase 45, from separator 18 is mixed with a second water stream 19 and sent to a separator 20. This second mixing of water and raffinate further reduces the solvent concentration in the raffinate Ra which becomes product stream 21.

Returning to the extractor column 14, a rich solvent stream 22 is removed at the bottom of the column 14, heated in a lean/rich heat exchanger 23, and is typically sent to a flash drum A at the top of a stripper column 24. While physically part of stripper column 24, the flash drum A is an isolated unit and operates at a higher pressure than tray portions BC of the stripper column 24 but at a lower pressure than extractor column 14. As stream 22 encounters the lower pressure in the flash drum A some of the hydrocarbons dissolved in the rich solvent stream 22 flash and exit stripper column 24 as a vapor stream 25. Because of low volatility of the solvent at the temperature and pressure in the flash drum A, vapor stream 25 contains virtually no solvent.

The solvent, carrying dissolved hydrocarbons therein, exits flash drum A as stream 26, and enters at an uppermost or top tray B1 position within the multitiered upper tray portion B of the stripper column 24. Because pressure in the stripper column tray portions BC is lower than in the flash drum A, another portion of the hydrocarbons dissolved in stream 26 flashes and exits the stripper column 24 as a vapor stream 28. The liquid portion of stream 26 which has not flashed flows down and across tiered trays B2 isolated from the top tray B1 in tray portion B, contacting an upwardly flowing vapor stream 29 to be defined hereinafter. As a result of the vapor-liquid contact between streams 26 and 29 in trays B2, the vapor stream 29 strips most of the non-aromatic hydrocarbons out of stream 26 and carries them out of the stripper column 24.

The vapor streams 28 and 29 flow into vapor stream 25 and the combined stream 25' flows to condenser 32. Once condensed, the stream 125 flows to a receiver 33.

Condensed hydrocarbons in the receiver 33 are recycled to the bottom of extractor column 14 as stream 34. The purpose of stream 34 is to control the purity of the extract 40. As stream 34 flow rate is increased, a similar increase must be seen in streams 25, 28 and/or 29. Whatever portion of the flow increase occurs in streams 25 or 28 provides no improvement in purity. In fact, increasing flow of either stream 25 or 28 often reduces purity, as shown recently in both simulation models and empirical tests. Only the portion of the flow increase produced with stream 29 improves the purity of extract E stream 40.

The means by which streams 25, 28 and 29 are generated helps explain why they produce such different results. Streams 25 and 28 are produced by the enthalpy of the rich solvent stream 26. Stream 29 is produced by stripping of non-aromatic hydrocarbons from stream 26 in trays B2 of portion B of the stripper column 24. As the flow rate of stream 29 increases, more of the non-aromatic hydrocarbons are removed.

Inside stripper column 24, the down-flowing rich solvent stream 26 contacts the up-flowing vapor stream 29. Such counter-current contact removes the non-aromatic hydrocarbons from the rich solvent stream 26. Because of a high degree of non-ideality introduced by the presence of solvent in stream 26, even non-aromatic hydrocarbons with up to 9 carbon atoms become volatile and can be removed from the rich solvent stream 26. Thus, the tiered trays B2 of portion B of the stripper column 24 function as an extractive distillation column.

Although not normally needed for most applications, non-aromatic hydrocarbons with 10 or more carbon atoms can also be made as volatile as benzene by increasing concentration of solvent in the down-flowing stream 26. The condensed hydrocarbon stream 34 recycled to the extractor column 14 thus contains almost all of the non-aromatic hydrocarbons stripped from rich solvent stream 26, plus a substantial amount of benzene and heavier aromatics.

Moving now to a bottom portion C of the stripper column 24, an upward-flowing steam vapor stream 30 is generated by a combination of a stripping stream 35 and a vapor stream 49 generated by a reboiler 36. In the bottom portion C of stripper column 24, upward-flowing vapor stream 30 strips dissolved aromatic hydrocarbons from the down-flowing rich liquid solvent stream 26 since virtually all of the non-aromatic hydrocarbons were removed in the upper portion B of the stripper column 24. A first portion of vapor stream 30 is removed as side-cut stream 37, is sent to a side-cut condenser 38 and flows to a side-cut receiver 39. The aromatic hydrocarbons are removed from the side-cut receiver 39 as the high purity aromatic extract 40. Another portion of stream 30 rises through portion B, becoming vapor stream 29 by stripping the non-aromatic hydrocarbons from fluid stream 26.

Water condensed from the stream 30 by condenser 38 and received in the side-cut receiver 39 is split into three streams. A first stream 41 is recycled to mix with the condensed side-cut stream 37 downstream of side-cut condenser 38 to ensure the removal of solvent strained within stream 37. A second stream 42 is sent to an accumulator 43. The third stream 19 is fed into separator 20 for washing the stream 45.

Since a substantial portion of vapor stream 30, which splits into side-cut stream 37 and vapor stream 29, is steam, a portion of vapor stream 29 rising through portion B of the stripper column 24 must also be steam. Therefore, some of the condensed material in receiver 33 will also be water which flows to the accumulator 43 as water stream 44.

A stream 46 from accumulator 43 flows to a tube and shell vaporizer 47 where a substantial portion of stream 46 is converted to vapor or steam, which generates stripping stream 35. It should be noted that several variations of this basic design of UDEX apparatus exist with some incorporating water columns and some having the vaporizer 47 on the rich solvent line 22 or 54.

Portion 48 of the down-flowing stream 26 which reaches a bottom area of tray portion C of stripper column 24 is looped through reboiler 36 and returned as vapor stream 49. A lean solvent stream 50, the net bottoms product from stripper column 24 flows to a tube side of the vaporizer 47. Boiling of water on a shell side of the vaporizer 47 reduces the temperature of the lean solvent stream 50. The lean solvent stream 50 then flows to lean/rich heat exchanger 23 (in a design in which a lean/rich exchanger is included) along line 51, and returns to the top of extractor column 14 as stream 52.

In an apparatus 10 where no exchanger 23 is provided, it will be understood that the stream 52 will be identical to stream 51, and will obviously be hotter than a stream 52 exiting an exchanger 23.

The down-flowing solvent stream 52 in the extractor column 14 contacts the upward-flowing hydrocarbon streams 11 and 34. This counter-current flow extracts virtually all of the aromatics and an equilibrium amount of non-aromatics from the upward-flowing stream 34, generating rich solvent stream 22.

Using gathered data, a steady state simulation model of the typical UDEX apparatus described above was prepared. Inasmuch as the model was set up to calculate compositions of internal as well as external streams, with multiple runs it became possible to understand what occurs in the flash drum A and at the isolated top tray B1 of portion B of the stripper column 24.

Based on the pressure in the flash drum A and in the top tray B1 of portion B in the stripper column 24, it is assumed that the vapor-liquid flashes taking place therein reduce vapor loading or stream velocity in the trays B2 of portion B of the stripper column 24. In this way, the diameter of the stripper column 24 is most probably reduced.

With the steady state model, it was possible to run a series of calculations in which the amount of vapor flashed in flash drum A to form stream 25 was reduced to zero. With every decrease in the amount of vapor flashed, purity of the extract 40 improved. Since the flow of hydrocarbon stream 34 was held constant, each decrease in the flow of vapor stream 25 from the flash drum A required an equal increase in flow of vapor streams 28 and 29 from stripper column 24. Thus, it appears that not all reflux materials, vapor streams 25, 28 and 29, effect extract 40 purity equally.

The next set of calculations methodically reduced the flow rate of hydrocarbon stream 34 until the purity of the extract 40 was returned to a starting point purity. This showed that the same extract 40 purity could be generated at significantly different flow rates of hydrocarbon stream 34. Thus, the unexpected result was that the purity of the extract 40 increased when the flow of hydrocarbon stream 34 was reduced in a specific manner.

The next set of simulation model runs involved reducing the amount of vapor flashed at the top tray B1 of portion B of stripper column 24. As with the vapor stream 25 produced in the flash drum A, the vapor stream 28 produced at the top tray B1 of portion B of the stripper column 24 had little effect on the purity of the extract 40. When the flow rate of the hydrocarbon stream 34 was held constant while the vapor stream 28 produced at the top tray B1 of portion B was reduced, the purity of the extract flow of 40 increased. Likewise, when the purity of hydrocarbon stream 34 decreased to the starting purity, less flow of stream 34 was required. Again, the surprising result of greater purity of extract 40 with less stream 34 flow was observed.

The vapor streams 25 and 28 produced at the flash drum A and at the top tray B1 of portion B of the stripper column 24, respectively, share one common factor: they do not contact a counter-current flow of liquid solvent stream 26 as do the remaining trays B2 of portion B of the stripper column 24. Thus, it appears that sequential flashes in the absence of contact with a counter-current flow of liquid solvent do not produce as much purification of extract 40 as does contacting the vapor stream 29 with the counter-current liquid solvent stream 26.

With existing technology, the normal range for the volumetric ratio of reflux to extract ("R/E") is 1.1 to 2.5, depending on the composition of the feed and the requirements for purity of the extract.

With the improvements proposed herein in place, this ratio drops to a range of 0.5 to 1.0. The reason for this reduction is that the new technology eliminates the portion of the reflux that does not enhance purity. The reflux generated in the flash drum A and on the top tray B1 of the stripper column 24 does not improve purity. Only the portion generated in the counter-current trayed section of the stripper column 24 selectively removes impurities.

To eliminate reflux in the flash drum A and the top tray B1 in the stripper column 24, energy must be removed from the rich solvent stream upstream of the flash drum A. This is accomplished with the new solvent cooler.

Most units now run at about 1.1 R/E. This should drop to approximately 0.6 with the proposed improvements, so most units will see a reduction of about 0.5.

By comparison, the vapor stream 29 flow from trays B2 of portion B of the stripper column 24 for the above models showed that, for constant extract 40 purity, the flow rate of the vapor stream 29 remained constant. A few more runs showed that this flow correlated well with extract 40 purity. Thus, the flow rate of stream 29 was found to determine the purity of the extract 40.

In addition to purity issues, the simulation model provided another surprise. As the flow of hydrocarbon stream 34 was reduced, the model showed that purity of the raffinate 21 increased. With less aromatics in the raffinate 21, the recovery of aromatics increased and the flow of extract 40 increased slightly. Therefore, a series of model runs was made to return the raffinate 21 purity to the starting point purity. Since recovery of aromatics is affected by lean solvent stream 52 flow, this flow was reduced.

With the current technology, the normal range for the volumetric ratio of solvent to feed ("S/F") is 3.0 to 5.0, depending on the composition of the feed.

With the proposed improvements, this will drop to a range of 2.0 to 2.8. The range reflects the difficulty of processing the particular feed.

As an example, for a feed comprising 50% aromatics and a solvent to feed ratio of 4.0, the solvent to extract ratio will be 8.0. This can be used to show how the improvement in the technology holds constant the concentration of hydrocarbons in the rich solvent stream 22 leaving the bottom of the extractor 14. The hydrocarbons consist of the extract and the reflux. Using E for extract flow, R for reflux flow and S for solvent flow, the equation for calculating the concentration of hydrocarbons in the rich solvent is:

$$\text{Hydrocarbons in solvent}=(E=R)/(E+R+S)$$

Dividing each term by E provides an equation that is easier to use:

$$=(E/E+R/E)/(E/E+R/E+S/E)$$

Starting with a solvent to feed ratio of 4.0 and 50% aromatics in the feed, the solvent to extract ratio will be 8.0. Likewise, with a reflux to feed ratio of 0.8, the reflux to extract ratio would be 1.6. Using these values, the concentration of hydrocarbons in the solvent is about:

$$(1.0+1.6)/(1.0+1.6+8.0)=24.5\%$$

With the proposed improvements, the S/E ratio will drop to 5.3 and the R/E will drop to 0.7:

$$(1.0+0.7)/(1.0/+0.7+5.3)=24.3\%$$

Thus, even with the modifications to the flow scheme, the heat balance and the key ratios, the concentration of the hydrocarbons in the solvent stream 22 at the bottom of the extractor 14 are about the same with both the new and old technologies. As a result, the selectivities will be about the same even though the energy consumption will be substantially reduced.

As the flow of lean solvent stream 52 was reduced, several things happened. First, as expected, the raffinate 21 was found to include more aromatics. Second, the lower flow rates of solvent stream 52 and hydrocarbon stream 34 decreased tray loadings in the extractor column 14 and stripper column 24. Third, with less solvent stream 52 flow, the flow of stripping stream 35 from the vaporizer 47 to the bottom of portion C of the stripper column 24 could be decreased.

From the standpoint of the flow of energy, the reboiler 36 of stripper column 24 provides the energy, for the process. Most of this energy is removed in the condensers 32 and 38 associated with the stripper column 24. Since the feed 11 and products 21 and 40 enter and leave the process at the same temperature, the reboiler 36 duty must balance the duties of the two condensers 32 and 38 and of the raffinate cooler 16. Thus, any change that reduces the duty of condenser 32 and/or condenser 38 must produce an equal change at the reboiler 36.

Reducing the flow of material to the flash drum A and the top tray B1 of portion B of the stripper column 24 reduces flow to the condenser 32. In practice, the energy to vaporize the hydrocarbons in the flash drum A and at the top tray B1 of portion B of the stripper column 24 actually comes from reboiler 36 and travels to the flash drum A in the enthalpy of the solvent stream 50, 51, 52, and 22. Thus, as the flow of hydrocarbon stream 34 decreases, the duties of the reboiler 36 and condenser 32 decrease by the same amount.

As the flow of lean solvent stream 52 decreases, the flow of stripping steam in stream 35 can be decreased. With less steam in stream 35 flowing up the stripper column 24, less will flow to both condensers 32 and 38. Thus, lower flow of solvent stream 52 also decreases the consumption of energy.

With the current technology, the ratio of stripping steam to solvent flow is in the range of 2 to 5% with the average about 4%. As described above, the solvent flow drops by about one-third. Since the basic job of stripping the hydrocarbons out of the solvent does not change with the new technology, the ratio of stripping steam to lean solvent will not change. Because the flow rate of solvent decreases by one-third, the flow of stripping steam also decreases by one-third.

As seen in the model, upon elimination of flashing of the rich solvent stream 22, the consumption of energy at the stripper reboiler 36 decreased from over 900 to about 600 BTU/pound of extract 40. In addition, upon decreasing flow rates of streams 35 and 26 in the stripper column 24, the tray loading in portions B and C of stripper column 24 dropped by nearly one half of previous valves.

The relative expense for the capacity of the UDEX apparatus 10 is strongly related to apparatus 10 capacity, relative primarily to extractor column 14 size, stripper column 24 size, and the need for the two stripper condensers 32 and 38 and the stripper reboiler 36.

Thus, modifying the UDEX process flow scheme as empirically determined and set forth above would reduce the load on all of the structures except for a top section of the extractor column 14.

Therefore, with the modified apparatus 10 described hereinbelow, used in the empirical testing, the feed stream 11 flow rate could be doubled after incorporating the above modifications into the improved process.

Turning now to a study of the modified apparatus 10 proposed herein for carrying out the improved process, it was first appreciated that hydrocarbon flashing in flash drum A needed to be eliminated.

To eliminate hydrocarbon flashing in flash drum A, it was determined that energy, in the form of heat, or enthalpy, must be removed from the solvent stream 22. The enthalpy in the solvent stream 22 was found to be useable in other areas of the apparatus 10.

The excess energy is in the solvent stream. This excess is removed in a cooler 70 on the solvent stream. While the cooler 70 can be in either the lean solvent or the rich solvent streams, the preferred embodiment is to insert the new cooler in the lean solvent line 52.

First, direct flow of liquid stream 26 from portion B2 to portion C of stripper column 24 was eliminated by placement of a suitable barrier 71 therebetween. As is known in the art, the stripper column 24 includes doors, (not shown) commonly referred to as manways, through which a worker can enter the column 24 with appropriate parts to create the barrier 71 by assemblage of the parts inside the column 24. Those skilled in the art will have full knowledge of use of such manways and erection of the barrier 71 within the column 24. It will be understood that a further barrier 79 is also commonly used to stop flow of vapor stream 29 to top tray B1 from the multitiered trays B2 located therebeneath in portion B2 of the stripper column 24. Then, a shell and tube heat exchange reboiler 60 could draw bottom stream 80 from portion B2, at a point just above the side-cut in the stripper column 24, therethrough, to heat same prior to routing the stream 80 into an upper area of portion C, the stream 80 being heated by transfer of heat thereto from lean solvent stream 50. Such increased temperature requires less flow of stripping steam in stream 35, further reducing the consumption of energy since the temperature of the lean solvent stream 50 leaving the bottom of the stripper column 24 is high enough to provide an adequate temperature difference for such heat exchange.

Second, since water stream 85 from the raffinate wash contains a significant amount of soluble non-aromatics, a stream 77 tapped off of stream 85 can be sent to a small hydrocarbon stripping column 74 which can be used to keep these non-aromatics out of the bottom portion C of the stripper column 24. Contamination of the extract 40 can be eliminated by sending these non-aromatics via line 78 to condenser 32. Further, the flow of stream 34 can be reduced by reducing energy input from reboiler 36. Lean solvent stream 50, even after coursing through reboiler 60, would still have a temperature high enough to supply energy to a reboiler 75 for the small column 74. A bottoms stream 76 from the column 74 containing water and solvent, in a preferred embodiment, would flow into the vaporizer 47.

Third, after coursing through reboiler 75 on the hydrocarbon stripping column 74, the lean solvent stream 50 would still be hot enough to provide energy to the vaporizer 47. Process calculations also indicated that the enthalpy of the solvent stream 50 would still be high enough to vaporize some of the hydrocarbons in the solvent stream 52. Therefore, a cooler 70, probably in the form of a cooling water exchanger 70, would be required to cool a substantial portion of the stream 52 prior to its entry into the extractor column 14, completing the improved apparatus 10.

Since sub-cooling rich solvent stream 22 upstream of flash drum A would increase reboiler 60 duty, it is proposed to control the flow of lean solvent stream 52 though the cooling water exchanger 70 by creating a secondary route 53 bypassing the cooler 70. Flow through the secondary route 53 is controlled by a valve 55 which is operated under control of a flow meter 72 electronically coupled thereto and provided for sensing an instantaneous rate of flow of the stream 25 from the flash drum A, with elimination of substantially all flow of the stream 25 being desired.

Substantially complete elimination of flow of stream 25 can be produced by manipulation of the valve 55 in a predetermined manner relative to a desired temperature for the solvent stream 52, by producing a degree of valve 55 closure sufficient to substantially eliminate flow of stream 25 by increasing the volume of lean solvent stream 52 flowing through the cooler 70 without sub-cooling the stream 52. Conversely, should it be found that sub-cooling of the stream 52 is taking place, it may be desirable to allow creation of a negligible rate of flow of stream 25 to a predefined upper limit by producing a degree of valve 55 opening to decrease the volume of stream 52 flowing through the cooler 70, thereby warming the stream 52 prior to its flowing into the extractor column 14.

With the current technology, there is no issue on removing energy from the solvent entering the flash drum A.

With the proposed improved flow scheme, the amount of energy in the solvent can be optimized. If the temperature is too high (as it is with the current technology), then some of the hydrocarbons in the rich solvent stream 22 vaporize in the flash drum A. This leads to more reflux flow, more solvent flow, more stripping steam flow, lower capacity and higher consumption of energy. If, on the other hand, the temperature of the rich solvent stream 22 is too low, then the stream 22 must be reheated to its bubble point with vapors from the reboiler consuming more energy. At the optimum, the rich solvent stream 22 entering the flash drum will be at its bubble point and the use of energy will be minimized.

To adjust the removal of energy from the solvent so that the stream 22 entering the flash drum A is at its bubble point, it is possible to monitor the flow of vapor from the flash drum A. To accomplish this, the pressure of the drum must be set at the pressure of the top of the stripper column 24. At this pressure, any vapor generated in the flash drum A represents the degree to which the solvent stream 22 contains too much energy. Therefore, the measurement of the flow of vapor from the flash drum A provides a signal or index that can be used to remove the excess heat from the solvent steam 22. With a cooler 70 on the solvent and control valves in place as proposed, the flow of vapor from the flash drum A can be used to adjust removal of excess energy from the solvent.

The last set of process calculations performed with the model investigated the water concentration in the lean solvent stream 50. After modifying the process flow scheme, the best combination of purity and recovery was obtained at about a 5 to 6% concentration of water. Higher concentrations lost recovery faster than gaining purity while lower concentrations produced the opposite effect.

As a side note, solvent additives such as ether glycol, while having significant effects at high water concentrations, were found to have negligible significance at the optimum water concentrations.

Almost all present day UDEX apparatus are believed to have the same process flow scheme, making the proposed modifications substantially universally applicable. Likewise, similar modifications appear applicable for use in other glycol solvent systems.

As described above, the method of the present invention provides a number of advantages, some of which have been described above and others of which are inherent in the invention. Also, modifications may be proposed to the method without departing from the teachings herein. Accordingly, the scope of the invention is only to be limited as necessitated by the accompanying claims.

We claim:

1. An improved apparatus for extraction of aromatic compounds from gasoline using a glycol solvent based extraction process, the apparatus comprising at least one stripper column including a flash drum at a top thereof, and continuous multitiered upper and bottom tray portions, the upper tray portion having a top tray which is isolated from the flash drum and from other tiers of the upper tray portion therebelow, and at least an extractor column upstream of the stripper column, the improvement comprising:

means for creating a barrier between the multitiered upper and bottom tray portions of the stripper column to eliminate a direct flow path therebetween;

means for diverting a flash vapor stream from the flash drum of the stripper column back to a column extractor upstream of the stripper column;

means for diverting a lean solvent stream exiting the bottom portion of the stripper column to a heat exchange unit to cool the solvent stream by transferring heat therefrom to a bottom stream from the top multitiered upper portion and diverting the bottom stream to an upper area of the bottom portion; and means for diverting the cooled lean solvent stream to a reboiler of a hydrocarbon stripper and using the hydrocarbon stripper to remove non-aromatics from a water stream used to separate solvent from the extracted aromatic compounds.

* * * * *